US006690121B1

(12) United States Patent
Weindorf

(10) Patent No.: US 6,690,121 B1
(45) Date of Patent: Feb. 10, 2004

(54) HIGH PRECISION LUMINANCE CONTROL FOR PWM-DRIVEN LAMP

(75) Inventor: Paul Fredrick Luther Weindorf, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/300,225

(22) Filed: Nov. 20, 2002

(51) Int. Cl.[7] ..... H05B 41/16

(52) U.S. Cl. ..... 315/247; 315/157; 315/158; 315/291; 315/307

(58) Field of Search ..... 315/247, 134, 315/149, 150, 157, 158, 169.2, 169.3, 291, 307, DIG. 4

(56) References Cited

U.S. PATENT DOCUMENTS

| | | | | |
|---|---|---|---|---|
| 5,231,344 A | * | 7/1993 | Marumoto et al. | 322/14 |
| 5,245,761 A | | 9/1993 | Waldherr | 33/767 |
| 5,654,605 A | * | 8/1997 | Kawashima | 310/316.01 |
| 5,726,536 A | * | 3/1998 | Hagiwara | 315/276 |
| 6,118,415 A | | 9/2000 | Olson | 345/41 |
| 6,198,234 B1 | | 3/2001 | Henry | 315/291 |
| 6,198,236 B1 | | 3/2001 | O'Neill | 315/3.7 |
| 6,239,558 B1 | | 5/2001 | Fujimura et al. | 315/307 |
| 6,294,883 B1 | | 9/2001 | Weindorf | 315/291 |
| 6,388,388 B1 | | 5/2002 | Weindorf et al. | 315/169.3 |
| 6,515,881 B2 | * | 2/2003 | Chou et al. | 363/95 |
| 2003/0160574 A1 | * | 8/2003 | Gray | 315/291 |

FOREIGN PATENT DOCUMENTS

JP 9180889 7/1997

OTHER PUBLICATIONS

George Henry, *LX1686 Direct Drive CCFL Inverter Design Reference*, 2000, pp. 1–27, Copyright 2000.

* cited by examiner

*Primary Examiner*—Don Wong
*Assistant Examiner*—Thuy Vinh Tran
(74) *Attorney, Agent, or Firm*—MacMillan, Sobanski & Todd, LLC

(57) ABSTRACT

A lamp brightness control for a lamp provides backlight illumination for a display. A brightness-to-current translator generates an electrical current command having a magnitude proportional to a desired lamp current that corresponds to a desired brightness. A PWM generator generates a PWM drive signal having a duty cycle determined in response to a control signal. A lamp driver switches power to the lamp in response to the PWM drive signal. A current sensor generates a current feedback signal in response to a flow of current in the lamp. An error amplifier generates the control signal in response to the electrical current command and the current feedback signal, whereby an actual lamp current is substantially equal to the desired lamp current despite any temperature offsets in the PWM generator or the lamp driver, for example.

10 Claims, 4 Drawing Sheets

HIGH PRECISION LUMINANCE CONTROL FOR PWM-DRIVEN LAMP

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to luminance control of fluorescent lamps, and, more specifically, to compensating for offsets and temperature variations in pulse-width modulation (PWM) circuits controlling lamp dimming.

Backlight display devices are used in a variety of consumer and industrial products to display data, charts, graphs, messages, other images, information, and the like. Backlight display devices have a backlight positioned to floodlight a display panel from the front or back. The backlight may be a fluorescent tube, an electroluminescent device, a gaseous discharge lamp, a plasma panel, and the like. The display panel display may be a passive or active matrix liquid crystal display (LCD), for example. The backlight and display panel are connected to control circuitry for providing a variable supply voltage in order to control brightness of the illumination. The display device may be separate or incorporated with other components, such as an electronic device in a dashboard of an automobile or other vehicle, a portable electronic device, and the like.

To control brightness, a driver circuit increases or decreases the drive current supplied to the backlight. The drive current typically is adjusted in relation to the environment (e.g., ambient lighting conditions) and user preferences. A lowly-lit environment usually requires less brightness, and thus a lower drive current, than a brightly-lit environment. The brightness may be changed automatically in response to the environment and/or manually. The backlight display device may have a switch, a keypad, a touch screen, a remote device, or the like to adjust the brightness.

Cold cathode fluorescent lamps (CCFLs) have been used as a backlight for LCDs. CCFLs are well suited to this application due to their low cost and high efficacy. High efficacy, which is equal to the ratio of light output to input power, is required because typical LCDs only transmit about 5% of the backlighting due to absorption of light in the polarizer and color filter of the LCD. In order to produce usable daytime lighting levels of approximately 400 Nits, the backlight must be capable of 20×400 Nits. One Nit is the luminance of one candle power measured one meter away over a meter by meter area, also known as a candela per meter squared. A cost effective backlighting technology which can provide such a lighting level is a fluorescent lamp.

Although the CCFL is an extremely efficient light source, it is difficult to control its illumination down to the low dimming levels required by, for example, night-time automotive environments. In some automotive applications, dimming at a barely discernable level (e.g., in the range of 1.0 Nit for an active matrix LCD) may be required. Accordingly, the CCFL controller must be capable of producing a dimming ratio of 400:1.

Most CCFL controllers have difficulty in controlling the absolute luminance down to this level. Some known systems obtain the desired dimming ratio by overdriving the lamp. However, this rapidly reduces the operating life of the lamp. Some military LCD systems use a first lamp for daytime illumination and a second, smaller lamp to produce the required night time lighting levels. However, systems which utilize dual lighting sources are not cost competitive in the automotive environment. Not only is a second lamp required, but a second controller is required as well.

Many control schemes have been used to control fluorescent lighting. Examples include voltage controlled self-resonant oscillators, pulse-by-pulse current pulse width modulated (PWM) control and PWM duty cycle control systems or combinations thereof. Pulse-by-pulse current PWM control systems characteristically operate at a frequency of 20 KHz to 100 KHz to control the lamp current. PWM duty cycle control of the CCFL luminance is accomplished by duty cycle control of the lamp's on time to the total periodic update time. For example, a PWM signal may be generated having a frequency of about 120 Hz and a duty cycle ranging from 100% down to less than 1%. During the "on" time of the PWM signal, a higher frequency (e.g., about 60 KHz) current supply is applied to the CCFL. The average drive current, and thus the total illumination, are reduced as the duty cycle is reduced.

While the backlight luminance is generally proportional to the drive current, the efficiency of the backlight may change during operation of the backlight display device. The changing efficiency varies the backlight luminance and hence the brightness of the backlight display device. The efficiency of the backlight display device usually is low at start-up and then increases during a "warm-up" period. Even after the warm-up period, the efficiency of the backlight may change during operation of the backlight display device, such as when the backlight display device moves through colder and warmer ambient conditions. The backlight efficiency may change due to the drive current level itself. Higher drive currents tend to increase the lamp temperature and lower drive currents tend to decrease the lamp temperature, thus changing the efficiency. The backlight efficiency also may change for other reasons such as little or no lumen maintenance over time and variations in thermal resistance and circuit operation.

U.S. Pat. No. 6,388,388, issued to Weindorf et al, discloses a brightness control system for a backlight display device that measures the efficiency of the backlight in order to achieve a desired brightness or luminance for the backlight display device. The backlight efficiency is a function of the lamp temperature. At each lamp temperature, the luminance is linearly proportional to a desired drive current for the backlight. By using the measured lamp temperature and known backlight efficiency to derive a desired lamp current and then controlling the PWM duty cycle to generate the desired lamp current, the brightness control system may maintain the desired brightness throughout the dynamic range of the backlight display device. U.S. Pat. No. 6,388,388 is incorporated herein by reference in its entirety.

CCFL drive current may be controlled using an integrated circuit inverter such as a direct drive, non-resonant, PWM controller. The LX1686 Direct Drive CCFL Inverter produced by the Linfinity Division of Microsemi Corporation is one example. The desired lamp current may be computed in a digital microcontroller in response to a digitized lamp temperature measurement. This lamp current value is converted to an analog signal having a magnitude that corresponds to a PWM duty cycle of the inverter that creates the desired average lamp current. The analog signal is coupled to the IC inverter as a brightness command.

Although the lamp current that is necessary in order to create the desired illumination is known, it has been found that errors in actual illumination level continue to occur. Furthermore, the errors are not consistent from device to device. It has been discovered that temperature variations, other offsets, and noise effects associated with the inverter IC and its external components cause variations in the transfer function associating the analog brightness command to the actual lamp current produced. For example, a ramp generator used to generate a PWM signal may exhibit drift over temperature or the input power supply may vary.

SUMMARY OF THE INVENTION

The present invention has the advantage of accurately maintaining a commanded lamp current without temperature measurement or compensation of the inverter components themselves. A closed loop feedback current control system corrects for the current errors no matter what their cause.

In one aspect of the invention, a lamp brightness control for a lamp provides backlight illumination for a display. A brightness-to-current translator generates an electrical current command having a magnitude proportional to a desired lamp current that corresponds to a desired brightness. A PWM generator generates a PWM drive signal having a duty cycle determined in response to a control signal. A lamp driver switches power to the lamp in response to the PWM drive signal. A current sensor generates a current feedback signal in response to a flow of current in the lamp. An error amplifier generates the control signal in response to the electrical current command and the current feedback signal, whereby an actual lamp current is substantially equal to the desired lamp current despite any offsets in the PWM generator or the lamp driver.

DETAILED DESCRIPTION OF PREFERRED EMBODIMENTS

Figure 2:
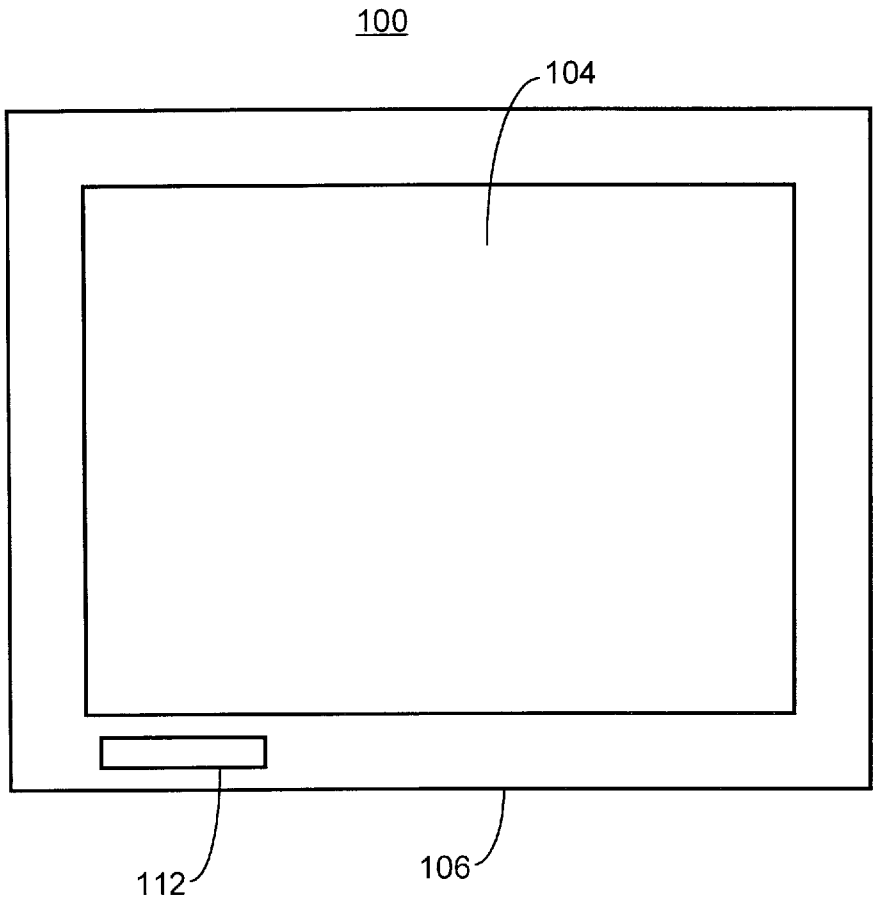
FIG. 2 is a front view of the backlight display device of FIG. 1.
Figure 1:
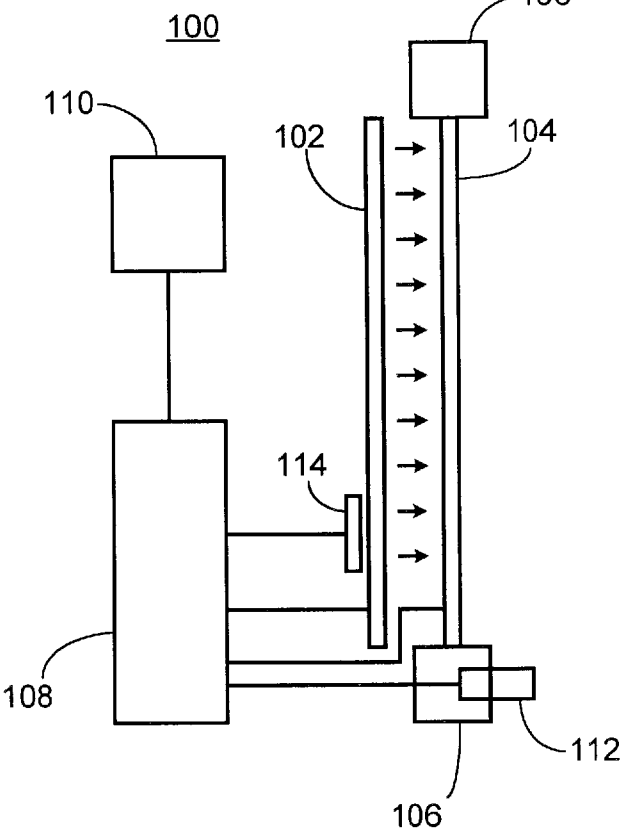
FIG. 1 is a side view of a backlight display device having a brightness control system.

FIGS. 1 and 2 show a backlight display device 100 including a backlight 102, a display panel 104, a bezel 106, control circuitry 108, a voltage supply 110, a user interface 112, and a temperature sensor 114. Backlight display device 100 may provide a reverse image for rear projection, may project an image onto a display surface (not shown), may have one or more magnification lenses (not shown) and reflective surfaces (not shown), may work with or have other components, and the like. The backlight display device 100 may be incorporated in a navigation radio system for an automobile or other vehicle. The backlight display device 100 may be built-in or integrated with a dashboard, control panel, or other part of an automobile or other vehicle. The backlight display device 100 also may be built-in or integrated with an electronic device, such as a laptop computer, personal organizer, and the like. Display panel 104 may comprise a liquid crystal display (LCD). The backlight 102 may be operatively disposed to provide light for operation of the display panel 104. The backlight 102 and the display panel 104 may be a passive or active matrix LCD, for example. In a preferred embodiment, backlight 102 is comprised of a cold cathode fluorescent lamp. Alternatively, backlight 102 may be comprised of one or more hot cathode fluorescent lamps, aligned fluorescent tubes, electroluminescent devices, gaseous discharge lamps, light emitting diode (LED), organic LEDs, plasma panels, a combination thereof, and the like.

In the preferred embodiment, the bezel 106 extends around and holds the outer perimeter of the display panel 104. The bezel 106 may have various configurations and may extend around part or only a portion of the outer perimeter. The bezel 106 may hold or extend around other components such as the backlight 102. The bezel 106 may include additional bezels and may be connected with or part of another component, such as a dashboard in an automobile.

The control circuitry 108 is connected to provide an image signal to the backlight 102 and the display panel 104. The control circuitry 108 may include one or more microprocessors and may be part of or incorporated with other circuitry, such as a central processing unit or a vehicle control unit. The control circuitry 108 may be completely or partially provided on one or more integrated circuit (IC) chips. The control circuitry 108 may have other circuitry for control and operation of the backlight display device 100, such as an inverter drive to supply drive current to backlight 102, a transceiver, one or more memory devices, analog components, and the like. The control circuitry 108 also is connected to a voltage supply 110, which may be provided by an automotive battery or electrical system, another type of battery, a household current supply, or other suitable power source.

The temperature sensor 114 is connected to the control circuitry 108 and is operatively disposed near the backlight 102. The temperature sensor 114 may be any temperature measurement device suitable for measuring the temperature of the backlight 102 and suitable for operating under environmental conditions of the backlight display device 100. "Operatively disposed near the backlight 102" includes any location or position where the temperature sensor 114 may provide a signal indicative of the temperature of the light source in the backlight 102. Temperature sensor 114 may comprise a thermistor or other temperature sensitive resistor attached directly to the backlight 102. The temperature sensor 114 may be bimetallic, ceramic, another material, or combination of materials having one or more electrical properties corresponding and changing in relation to the temperature of the backlight 102. Alternatively, an infrared temperature sensor may be used.

The brightness control system determines the instantaneous efficiency of the backlight 102 in order to achieve the desired brightness or luminance of the backlight display device 100. As discussed below, the backlight efficiency is a function of the lamp temperature. At each lamp temperature, the brightness is linearly proportional to the drive current or power for the backlight. By using the lamp temperature to infer backlight efficiency which then indicates the drive current corresponding to the desired brightness, the brightness control system may maintain the desired brightness throughout the dynamic range of the backlight display device 100. The dynamic range may encompass various ambient conditions, including the temperature range, encountered in the automobile environment.

Figure 3:
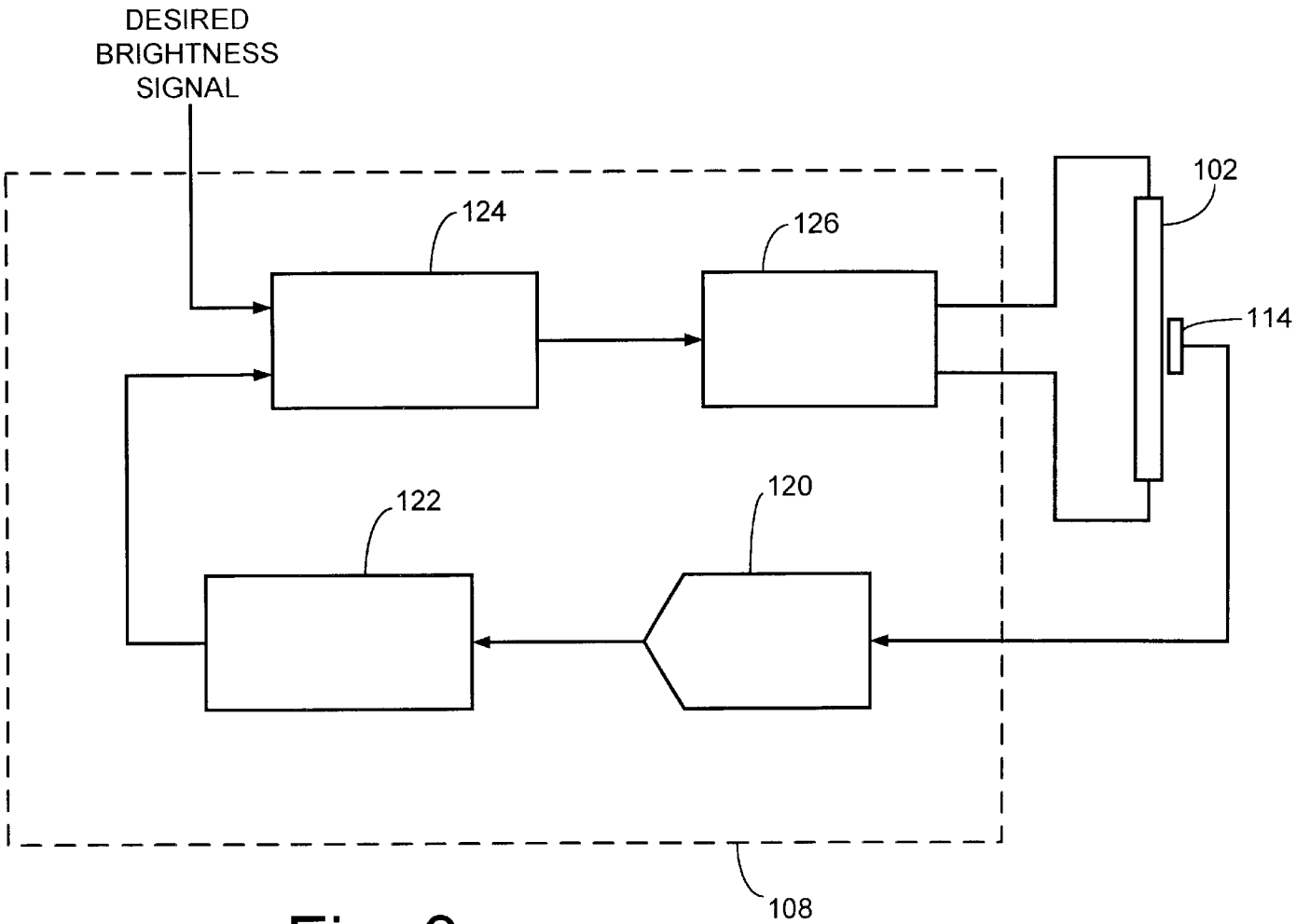
FIG. 3 is a block diagram of a brightness control system.

As shown in FIG. 3, control circuitry 108 includes an analog-to-digital converter (ADC) 120, a backlight efficiency calculator 122, a backlight drive calculator (BDC) 124, and a backlight driver 126. Temperature sensor 114 generates an analog signal indicative of the temperature of the backlight 102. ADC 120 converts the analog signal into a digital temperature signal. The backlight efficiency calculator 122 determines backlight efficiency in response to the digital temperature signal. The backlight drive calculator 124 determines a desired drive current level in response to the backlight efficiency and a desired brightness. The desired brightness signal may be a commanded brightness signal from a manual or automatic brightness control system. The desired drive current level may preferably be calculated as shown in U.S. Pat. No. 6,388,388 .

Driver 126 may be comprised of an LX 1686 CCFL inverter integrated circuit, for example. If driver 126 is to be driven by an analog command signal, then the desired current level in drive calculator 124 may be converted to an analog voltage by a digital-to-analog converter (not shown). A commanded lamp current provided to driver 126 is appropriately scaled by drive calculator 124 prior to conversion to an analog electrical current command according to a nominal transfer function of driver 126. Due to temperature and other effects in driver 126, however, the actual lamp current flowing in backlight 102 could differ in prior art brightness control systems.

Figure 4:
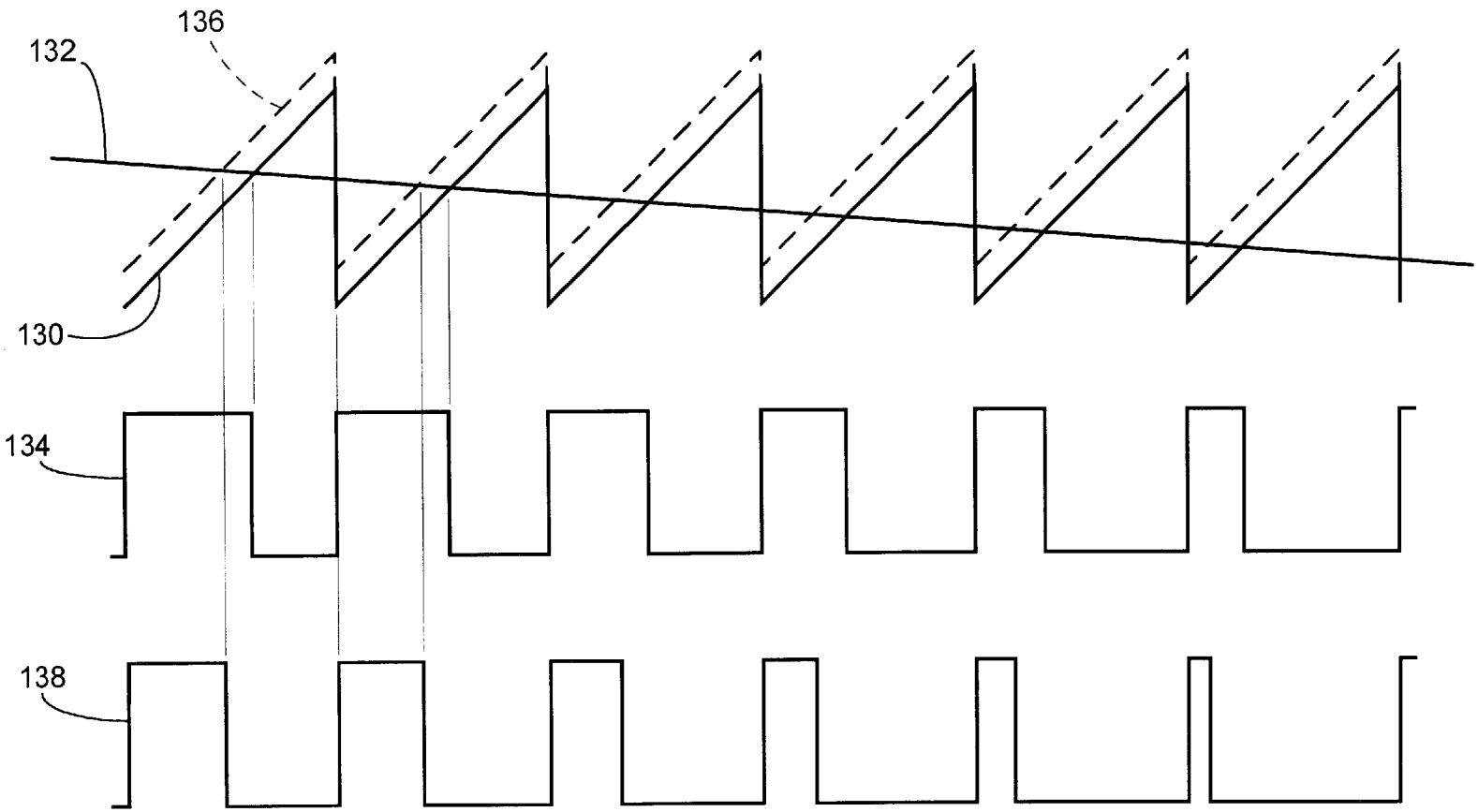
FIG. 4 shows sample waveforms for describing the invention.

As shown in FIG. 4, an integrated circuit driver/inverter such as the LX1686 integrated circuit may use a ramp signal 130 for comparing with a brightness command 132 to generate a PWM duty cycle for controlling lamp "on" times. When brightness command 132 is greater in magnitude than ramp signal 130, then a PWM drive signal 134 has a high logic level for turning on an inverter supplying high frequency current (e.g., about 60 to 80 KHz) to backlight 102.

Ramp signal 130 is shown for a nominal voltage level at a nominal temperature. Temperature variations and other offset errors may cause the ramp signal to drift to the position shown by ramp signal 136. Any positive or negative change in the level of the ramp signal changes the times when the ramp signal crosses the voltage level of brightness command 132. The resulting PWM drive signal 138 has "on" times with incorrect durations for generating the desired lamp current. Since the "on" times for driving backlight 102 are not accurate, backlight 102 displays an incorrect brightness.

Figure 5:
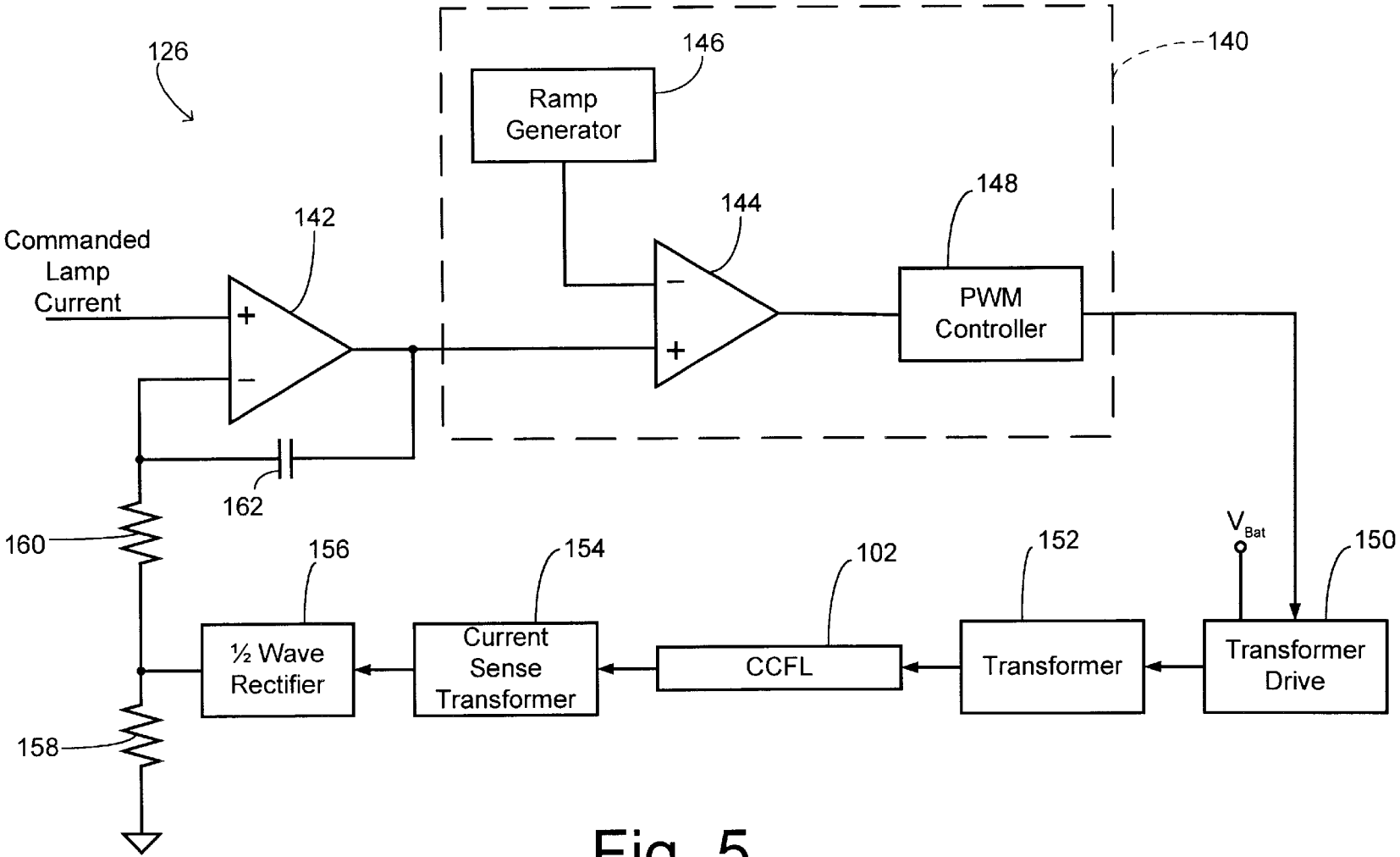
FIG. 5 is a schematic, block diagram showing a preferred embodiment of a current feedback loop of the present invention.

The present invention corrects for the foregoing problem by adding a feedback control loop for the current flowing in the backlight as shown in FIG. 5. Backlight driver 126 includes a PWM inverter IC 140, which may be comprised of an LX1686as described above. A commanded lamp current from backlight drive calculator 124 is coupled to the noninverting input of an error amplifier 142, which may be a high gain operational amplifier. Error amplifier 142 generates a control signal for inputting to PWM inverter 140 at the noninverting input of a comparator 144. A ramp generator 146 generates a ramp signal which is provided to the inverting input of comparator 144. The output of comparator 144 is coupled to a PWM controller 148. A PWM drive signal is provided from PWM controller 148 to a transformer driver 150 which applies switched battery power during the "on" times of the PWM drive signal to a transformer 152 connected to CCFL backlight 102.

A measure of electrical current flow through backlight 102 is obtained using a current-sensing device 154 (such as a current transformer, resistor, or the like) in series with backlight 102. A sensed current signal is rectified in a half-wave or full-wave rectifier 156 and applied across a sample resistor 158 to generate a voltage proportional to instantaneous lamp current. The instantaneous lamp current measurement is coupled by a feedback resistor 160 as a current feedback signal to the inverting input of error amplifier 142. A capacitor 162 is coupled between the output and the inverting input of error amplifier 142 to form an integrator. By using an integrator configuration of error amplifier 142, a voltage proportional to the average actual lamp current is presented to the inverting input. The output of error amplifier 142 controls the PWM duty cycle so that the average current at the inverting input is made equal to the lamp electrical current command from drive calculator 124 (i.e., by integrating the difference between the commanded lamp current and the current feedback signal). Thus, any offsets associated with temperature of ramp generator components or other lamp driver components are eliminated. In addition, luminance variations created by noise or lamp pulse quantization are also reduced because of the averaging affect of the integrating error amplifier.

The frequency of the PWM drive signal (which is determined by the frequency of the ramp signal) may be in the range of about 100 to 200 Hz, while the lamp current during an "on" time of the PWM drive signal may have a frequency in the range of about 60 to 80 KHz, for example. In order that the current feedback signal is averaged by error amplifier 142, the integrator comprised of error amplifier 142, resistor 160, and capacitor 162 is designed to provide an open loop pole at a pole frequency less than that of the PWM drive signal.

The present invention can be used advantageously in combination with the "backlight efficiency" method of prior U.S. Pat. No. 6,388,388 and with a low dimming anti-flicker control circuit as shown in pending application Ser. No. 09/917,128, filed Jul. 27, 2001, entitled "Cold Cathode Fluorescent Lamp Low Dimming Antiflicker Control Circuit" which is incorporated herein by reference in its entirety.

What is claimed is:

1. A lamp brightness control for a lamp providing backlight illumination for a display, comprising:

a brightness-to-current translator for generating an electrical current command having a magnitude proportional to a desired lamp current that corresponds to a desired brightness;

a PWM generator for generating a PWM drive signal having a duty cycle determined in response to a control signal;

a lamp driver for switching power to said lamp in response to said PWM drive signal;

a current sensor for generating a current feedback signal in response to a flow of current in said lamp; and an error amplifier for generating said control signal in response to said electrical current command and said current feedback signal, whereby an actual lamp current is substantially equal to said desired lamp current.

2. The lamp brightness control of claim 1 wherein said error amplifier is comprised of an integrator for generating said control signal as an integration of a difference between said electrical current command and said current feedback signal.

3. The lamp brightness control of claim 1 wherein said PWM generator includes a ramp voltage generator generating a ramp signal and a comparator comparing said ramp signal and said control signal so that said PWM drive signal has a first voltage when said ramp signal is less than said control signal and has a second voltage when said ramp signal is greater than said control signal.

4. The lamp brightness control of claim 1 wherein said PWM drive signal has a predetermined PWM frequency, wherein said actual lamp current has a predetermined lamp frequency greater than said PWM frequency, and wherein said error amplifier is characterized by an open loop pole at a pole frequency less than said predetermined PWM frequency, whereby said current feedback signal is averaged by said error amplifier.

5. The lamp brightness control of claim 1 wherein said lamp is a cold cathode fluorescent lamp.

6. A method of controlling brightness from a lamp for backlighting a display, said method comprising the steps of:

generating an electrical current command having a magnitude proportional to a desired lamp current that corresponds to a desired brightness;

generating a PWM drive signal having a duty cycle determined in response to a control signal;

switching power to said lamp in response to said PWM drive signal;

generating a current feedback signal in response to a flow of current in said lamp; and generating said control signal in response to said electrical current command and said current feedback signal, whereby an actual lamp current is substantially equal to said desired lamp current.

7. The method of claim 6 wherein said step of generating said control signal is comprised of integrating a difference between said electrical current command and said current feedback signal.

8. The method of claim 6 wherein said step of generating said PWM drive signal is comprised of generating a ramp signal and comparing said ramp signal and said control signal so that said PWM drive signal has a first voltage when said ramp signal is less than said control signal and has a second voltage when said ramp signal is greater than said control signal.

9. The method of claim 6 wherein said PWM drive signal has a predetermined PWM frequency, wherein said actual lamp current has a predetermined lamp frequency greater than said PWM frequency, and wherein said error amplifier is characterized by an open loop pole at a pole frequency less than said predetermined PWM frequency, whereby said current feedback signal is averaged by said error amplifier.

10. The method of claim 6 wherein said lamp is comprised of a cold cathode fluorescent lamp.

* * * * *